US007254957B2

(12) United States Patent
Weber et al.

(10) Patent No.: US 7,254,957 B2
(45) Date of Patent: Aug. 14, 2007

(54) METHOD AND APPARATUS FOR COOLING WITH COOLANT AT A SUBAMBIENT PRESSURE

(75) Inventors: Richard Martin Weber, Prosper, TX (US); William Gerald Wyatt, Plano, TX (US)

(73) Assignee: Raytheon Company, Waltham, MA (US)

( * ) Notice: Subject to any disclaimer, the term of this patent is extended or adjusted under 35 U.S.C. 154(b) by 262 days.

(21) Appl. No.: 11/058,691

(22) Filed: Feb. 15, 2005

(65) Prior Publication Data

US 2006/0179861 A1 Aug. 17, 2006

(51) Int. Cl.
*F25D 23/12* (2006.01)

(52) U.S. Cl. ..... 62/259.2; 165/80.3; 165/104.21

(58) Field of Classification Search ..... 62/259.2, 62/259.1, 475; 165/80.3, 104.21, 201, 281
See application file for complete search history.

(56) References Cited

U.S. PATENT DOCUMENTS

| | | | |
|---|---|---|---|
| 1,528,619 | A | 3/1925 | Alphonse |
| 1,906,422 | A | 5/1933 | Roulton |
| 2,321,964 | A | 6/1943 | Zieber |
| 2,371,443 | A | 3/1945 | Harold |
| 3,131,548 | A | 5/1964 | Chubb et al. |
| 3,174,540 | A | 3/1965 | Dutton |
| 3,371,298 | A | 2/1968 | Narbut |

(Continued)

FOREIGN PATENT DOCUMENTS

| | | |
|---|---|---|
| DE | 1220952 | 3/1968 |

(Continued)

OTHER PUBLICATIONS

U.S. Appl. No. 10/192,891, filed Jul. 11, 2002, entitled "*Method and Apparatus for Cooling with Coolant at a Subambient Pressure*", 21 pages of text and 2 pages of drawings.

(Continued)

*Primary Examiner*—Melvin Jones
(74) *Attorney, Agent, or Firm*—Baker Botts L.L.P.

(57) ABSTRACT

According to one embodiment, an apparatus includes a fluid coolant and structure which reduces a pressure of the fluid coolant through a subambient pressure at which the coolant has a cooling temperature less than a temperature of the heat-generating structure. The apparatus also includes structure that directs a flow of the fluid coolant in the form of a liquid at a subambient pressure in a manner causing the liquid coolant to be brought into thermal communication with the heat-generating structure. The heat from the heat-generating structure causes the liquid coolant to boil and vaporize so that the coolant absorbs heat from the heat-generating structure as the coolant changes state. The structure is configured to circulate the fluid coolant through a flow loop while maintaining the pressure of the fluid coolant within a range having an upper bound less than ambient pressure. The apparatus also includes a first heat exchanger for exchanging heat between the fluid coolant flowing through the loop and a second coolant in an intermediary loop so as to condense the fluid coolant flowing through the loop to a liquid. The apparatus also includes a second heat exchanger for exchanging heat between the second coolant in the intermediary cooling loop and a body of water on which the ship is disposed.

19 Claims, 2 Drawing Sheets

U.S. PATENT DOCUMENTS

| | | | | |
|---|---|---|---|---|
| 3,586,101 | A | 6/1971 | Chu | 165/101 |
| 3,609,991 | A | 10/1971 | Chu et al. | |
| 3,756,903 | A | 9/1973 | Jones | |
| 3,774,677 | A | 11/1973 | Antonetti et al. | 165/39 |
| 3,989,102 | A | 11/1976 | Jaster et al. | 165/107 |
| 4,003,213 | A | 1/1977 | Cox | 62/124 |
| 4,019,098 | A | 4/1977 | McCready et al. | 361/385 |
| 4,129,180 | A | 12/1978 | Larinoff | |
| 4,169,356 | A | 10/1979 | Kingham | |
| 4,295,341 | A | 10/1981 | Gale | |
| 4,301,861 | A | 11/1981 | Larinoff | |
| 4,330,033 | A | 5/1982 | Okada et al. | 165/104.27 |
| 4,381,817 | A | 5/1983 | Brigida et al. | 165/110 |
| 4,495,988 | A | 1/1985 | Grossman | 165/96 |
| 4,511,376 | A | 4/1985 | Coury | 55/36 |
| 4,794,984 | A | 1/1989 | Lin | 165/133 |
| 4,851,856 | A | 7/1989 | Altoz | 343/720 |
| 4,938,280 | A | 7/1990 | Clark | 165/80.4 |
| 4,945,980 | A | 8/1990 | Umezawa | 165/101 |
| 4,998,181 | A | 3/1991 | Haws et al. | 361/385 |
| 5,067,560 | A | 11/1991 | Carey et al. | |
| 5,086,829 | A | 2/1992 | Asakawa | |
| 5,128,689 | A | 7/1992 | Wong et al. | 343/853 |
| 5,148,859 | A | 9/1992 | Beamer | 165/41 |
| 5,161,610 | A | 11/1992 | Leidinger | 165/41 |
| 5,168,919 | A | 12/1992 | Berenholz et al. | 165/80.4 |
| 5,181,395 | A | 1/1993 | Carpenter et al. | |
| 5,239,443 | A | 8/1993 | Fahey et al. | 361/689 |
| 5,245,839 | A * | 9/1993 | Chang et al. | 62/292 |
| 5,261,246 | A | 11/1993 | Blackmon et al. | 62/85 |
| 5,333,677 | A | 8/1994 | Molivadas | 165/32 |
| 5,493,305 | A | 2/1996 | Wooldridge et al. | 342/368 |
| 5,497,631 | A | 3/1996 | Lorentzen et al. | |
| 5,501,082 | A | 3/1996 | Tachibana et al. | 62/149 |
| 5,515,690 | A | 5/1996 | Blackmon et al. | 62/85 |
| 5,522,452 | A | 6/1996 | Mizuno et al. | |
| 5,605,054 | A * | 2/1997 | Chen | 62/195 |
| 5,701,751 | A | 12/1997 | Flores | |
| 5,815,370 | A | 9/1998 | Sutton | |
| 5,818,692 | A | 10/1998 | Denney, Jr. et al. | 361/699 |
| 5,841,564 | A | 11/1998 | McDunn et al. | 359/61 |
| 5,862,675 | A | 1/1999 | Scaringe et al. | |
| 5,910,160 | A | 6/1999 | Cakmakci et al. | 62/195 |
| 5,943,211 | A | 8/1999 | Havey et al. | 361/699 |
| 5,950,717 | A | 9/1999 | Fay | |
| 5,960,861 | A | 10/1999 | Price et al. | 165/80.03 |
| 6,018,192 | A | 1/2000 | Root et al. | 257/714 |
| 6,052,284 | A | 4/2000 | Suga et al. | |
| 6,055,154 | A | 4/2000 | Azar | 361/688 |
| 6,292,364 | B1 | 9/2001 | Fitzgerald et al. | 361/699 |
| 6,297,775 | B1 | 10/2001 | Haws et al. | 343/700 |
| 6,305,463 | B1 | 10/2001 | Salmonson | |
| 6,366,462 | B1 | 4/2002 | Chu et al. | |
| 6,498,725 | B2 | 12/2002 | Cole et al. | 361/700 |
| 6,519,955 | B2 | 2/2003 | Marsala | 62/119 |
| 6,529,377 | B1 | 3/2003 | Nelson et al. | |
| 6,536,516 | B2 | 3/2003 | Davies et al. | |
| 6,594,479 | B2 | 7/2003 | Ammar et al. | |
| 6,679,081 | B2 | 1/2004 | Marsala | 62/259.2 |
| 6,708,511 | B2 | 3/2004 | Martin | |
| 6,827,135 | B1 | 12/2004 | Kramer et al. | |
| 6,952,345 | B2 | 10/2005 | Weber et al. | |
| 6,952,346 | B2 | 10/2005 | Tilton et al. | |
| 6,957,550 | B2 | 10/2005 | Wyatt et al. | |
| 6,976,527 | B2 | 12/2005 | Kirshberg et al. | |
| 7,000,691 | B1 | 2/2006 | Weber | |
| 2003/0053298 | A1 | 3/2003 | Yamada et al. | |
| 2003/0062149 | A1 | 4/2003 | Goodson et al. | |

FOREIGN PATENT DOCUMENTS

| | | |
|---|---|---|
| EP | 0 243 239 A2 | 4/1987 |
| EP | 02 51 836 A1 | 5/1987 |
| EP | 0 817 263 A2 | 10/1991 |
| EP | 0 666 214 A1 | 8/1995 |
| EP | 1 143 778 A1 | 3/2001 |
| EP | 1 380 799 A2 | 5/2003 |
| EP | 1 381 083 A2 | 1/2004 |
| FR | 2 730 556 A1 | 2/1995 |
| JP | 4-316972 | 9/1992 |
| WO | WO 00/65890 | 2/2000 |
| WO | WO 02/23966 A2 | 3/2002 |

OTHER PUBLICATIONS

U.S. Appl. No. 10/193,571, filed Jul. 11, 2002, entitled "*Method and Apparatus for Removing Heat from a Circuit*", 33 pages of text and 3 pages of drawings.

U.S. appl. No. 10/440,716, filed May 19, 2003, entitled "*Method and Apparatus for Extracting Non-Condensable Gases in a Cooling System*", 21 pages of text and 1 page of drawings.

EPO Search Report dated Oct. 25, 2004 for Patent No. 03254283.9-2203; Reference No. JL3846.

EPO Search Report dated Nov. 3, 2004 for Patent No. 03254285.4-2301; Reference No. JL3847.

PCT Notification of Transmittal of The International Search Report or the Declaration dated Sep. 27, 2004 for PCT/US2004/015086.

Dirk Van Orshoven, "*The use of water as a refrigerant—an exploratory investigation*", Thesis at the University of Wisconsin-Madison, XP-002121470 (pp. I, III-XIII, pp. 114) 1991.

U.S. Appl. No. 10/853,038, filed May 25, 2004, entitled "*Method and Apparatus for Controlling Cooling With Coolant at a Subambient Pressure*", 25 pages of text and 4 pages of drawings.

Margaret Ingels, ("pp. 59 and 80 of *Willis Haviland Carrier Father of Air Conditioning*", Country Life Press—Garden Cty (1952).

"An Integrated Thermal Architecture for Thermal Management of High Power Electronics", High Power Electronics, http:www.coolingzone.com/Guest/News/NL_JAN_2003/Thermacore/ Thermacore Jan 2003, 22 pages.

Beaty, et al., "New Guidelines for Data Center Cooling", Dec. 2003; 8 pages.

Wilson, et al., "A Thermal Bus System for Cooling Electronic Components in High-Density Cabinets", 2004 AHSRAE Transactions; Symposia, pp. 567-573.

Center for the Analysis and Dissemination of Demonstrated Energy Technology (CADDET), Cooling plant at LEGO uses water as refrigerant, Sep. 1997.

Muller, Norbert, Ph.D. Turbo Chillers using Water as a Refrigerant, Michigan State University, AMSE Process Industry Division PID Newsletter, Fall 2002, p. 3.

Maab, Jurgen and Feddeck, Paul, BINE Projectinfo, BINE Informationsdienst, Wasser als Kaltemittel, Aug. 2003.

"Subcooled Flow Boiling With Flow Pattern Control" IBM Technical Disclosure Bulletin, vol. 22, Issue 5, pp. 1843-1844 Oct. 1, 1979.

EP Search Report dated Mar. 4, 2005 for European Patent Application No. EP 04256509.3-2220.

Notification of Transmittal of the International Search Report and the Written Opinion of the International Searching Authority or the Declaration Int'l Application No. PCT/US2005/1020544; date of mailing: Oct. 10, 2005; Int'l filing date Jun. 10, 2005; 3 pages.

"International Search Report", Int'l Application No. PCT/US2005/020544; Earliest Priority Date: Jun. 14, 2004; Int'l filing date: Jun. 10, 2005; 5 pages.

"Written Opinion of the International Searching Authority," Int'l Application No. PCT/US2005/020544; Earliest Priority Date: Jun. 14, 2004; Int'l filing date: Jun. 10, 2005; International Patent Classification: F25B43/04; 9 pages.

* cited by examiner 100
104
102
PROCESSING EQUIPMENT
118
120
110
SACS
144
138
160
148
116
114
103
PUMP
154
146
150
152

METHOD AND APPARATUS FOR COOLING WITH COOLANT AT A SUBAMBIENT PRESSURE

TECHNICAL FIELD OF THE INVENTION

This invention relates in general to cooling techniques and, more particularly, to a method and apparatus for cooling a system that generates a substantial amount of heat through use of coolant at a subambient pressure.

BACKGROUND OF THE INVENTION

Some types of electronic circuits use relatively little power, and produce little heat. Circuits of this type can usually be cooled satisfactorily through a passive approach, such as convection cooling. In contrast, there are other circuits that consume large amounts of power, and produce large amounts of heat. One example is the circuitry used in a phased array antenna system.

More specifically, a modern phased array antenna system can easily produce 25 to 30 kilowatts of heat, or even more. One known approach for cooling this circuitry is to incorporate a refrigeration unit into the antenna system. However, suitable refrigeration units are large, heavy, and consume many kilowatts of power in order to provide adequate cooling. For example, a typical refrigeration unit may weigh about 200 pounds, and may consume about 25 to 30 kilowatts of power in order to provide about 25 to 30 kilowatts of cooling. Although refrigeration units of this type have been generally adequate for their intended purposes, they have not been satisfactory in all respects.

In this regard, the size, weight and power consumption characteristics of these known refrigeration systems are all significantly larger than desirable for an apparatus such as a phased array antenna system. And given that there is an industry trend toward even greater power consumption and heat dissipation in phased array antenna systems, continued use of refrigeration-based cooling systems would involve refrigeration systems with even greater size, weight and power consumption, which is undesirable. In such systems, it is often important that stable cooling is achieved during both startup and when the cooled device is subjected to wide swings in required cooling capacities.

SUMMARY OF THE INVENTION

According to one embodiment an apparatus includes a fluid coolant and structure which reduces a pressure of the fluid coolant through a subambient pressure at which the coolant has a cooling temperature less than a temperature of the heat-generating structure. The apparatus also includes structure that directs a flow of the fluid coolant in the form of a liquid at a subambient pressure in a manner causing the liquid coolant to be brought into thermal communication with the heat-generating structure. The heat from the heat-generating structure causes the liquid coolant to boil and vaporize so that the coolant absorbs heat from the heat-generating structure as the coolant changes state. The structure is configured to circulate the fluid coolant through a flow loop while maintaining the pressure of the fluid coolant within a range having an upper bound less than ambient pressure. The apparatus also includes a first heat exchanger for exchanging heat between the fluid coolant flowing through the loop and a second coolant in an intermediary loop so as to condense the fluid coolant flowing through the loop to a liquid. The apparatus also includes a second heat exchanger for exchanging heat between the second coolant in the intermediary cooling loop and a body of water on which the ship is disposed.

According to another embodiment, a method for cooling includes providing a primary fluid coolant in reducing a pressure of the primary fluid coolant to a subambient pressure at which the primary coolant has a cooling temperature less than a temperature of the heat of the heat-generating structure. The method also includes bringing the primary coolant at the subambient pressure into thermal communication with the heat-generating structure so that the primary coolant boils and vaporizes to thereby absorb heat from the heat-generating structure. The method also includes circulating the primary coolant through a flow loop while maintaining the pressure of the primary coolant within a range having an upper bound less than the ambient pressure. The flow loop is in thermal communication with a heat exchanger for removing heat from the primary coolant so as to condense the primary coolant to a liquid. The method also includes providing an intermediary cooling loop in thermal communication with the heat exchanger and exchanging, by the heat exchanger, heat from the primary coolant with an intermediary loop coolant in the intermediary cooling loop. The method also includes exchanging heat from the intermediary cooling loop coolant with a sink fluid.

Some embodiments of the invention may provide numerous technical advantages. Other embodiments may realize some, none, or all of these advantages. For example, according to one embodiment, the temperature of a plurality of heat-generating devices on a ship, such as phase array antennas, may be maintained at a desired temperature through a subambient cooling system that sinks the generated heat to the body of water through an intermediary cooling loop. Such an approach can in some embodiments result in substantial heat dissipation without use of compressors. The avoidance of the use of compressors frees up valuable space on the ship. Further, in some embodiments, large vapor lines can be avoided.

Other advantages may be readily ascertainable by those skilled in the art.

BRIEF DESCRIPTION OF THE DRAWINGS

A more complete understanding of embodiments of the invention will be apparent from the detailed description taken in conjunction with the accompanying drawings in which.

DETAILED DESCRIPTION OF EXAMPLE EMBODIMENTS OF THE INVENTION

Figure 1:
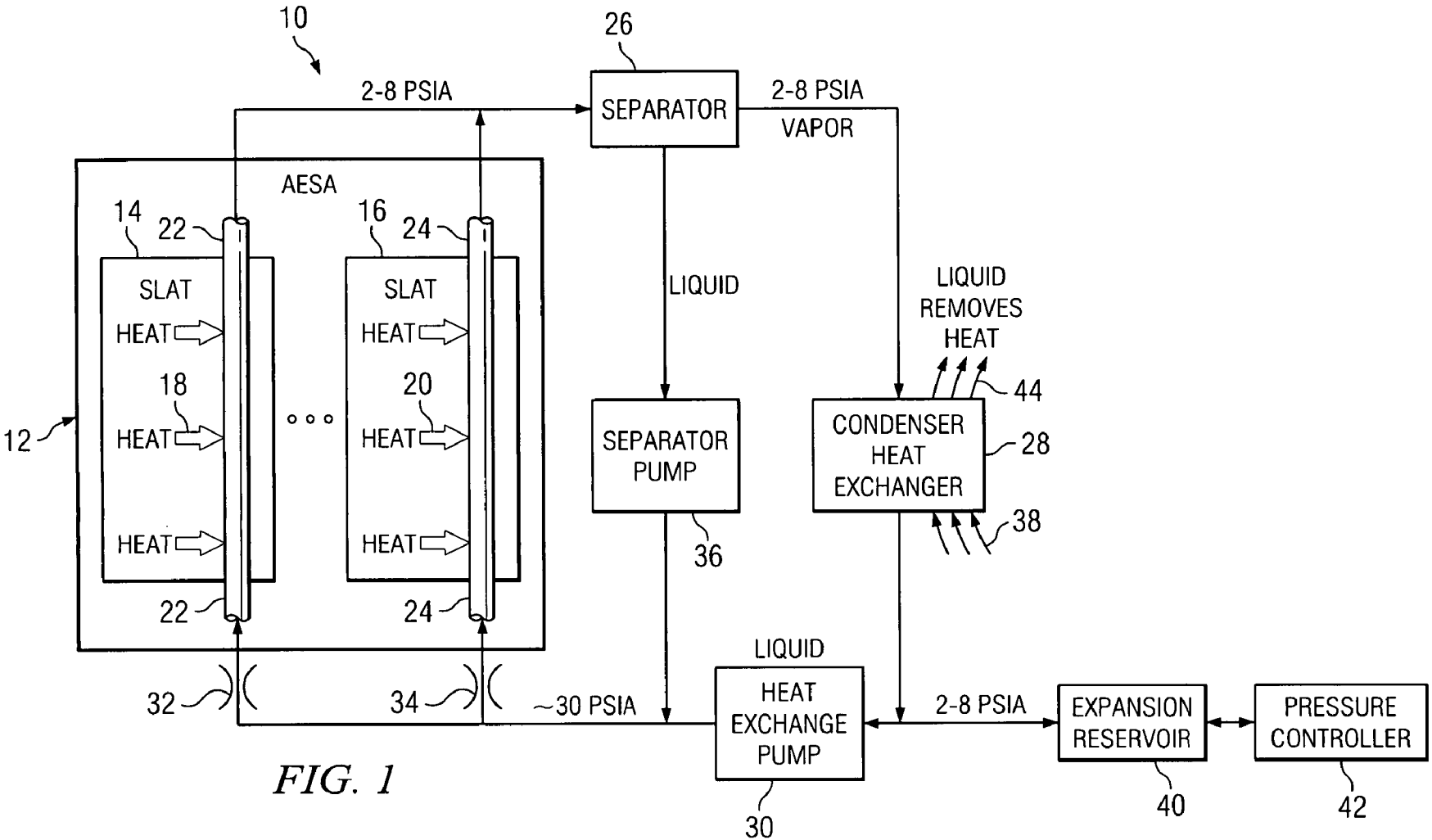
FIG. 1 is a block diagram of an apparatus that includes a phased array antenna system and an associated cooling arrangement that embodies aspects of the present invention.
Figure 2:
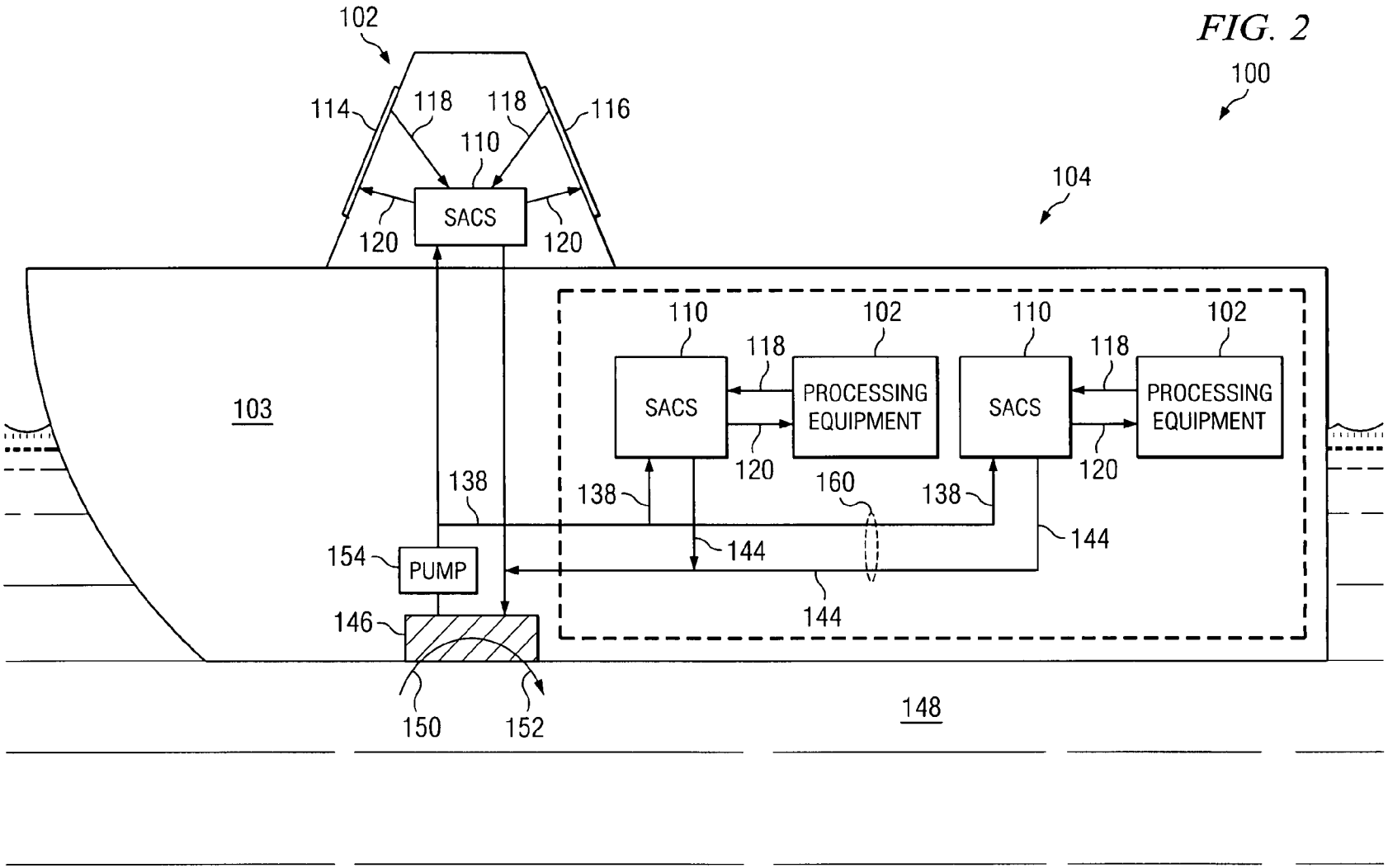
FIG. 2 is a block diagram of the apparatus of FIG. 1 showing additional details related to the control of the system of FIG. 1.

Example embodiments of the present invention and their advantages are best understood by referring to FIGS. 1-2 of the drawings, like numerals being used for like and corresponding parts of the various drawings.

FIG. 1 is a block diagram of an apparatus 10 that includes a phased array antenna system 12. In one embodiment, the antenna system 12 includes a plurality of identical modular parts that are commonly known as slats, two of which are depicted at 14 and 16. A feature of the present invention involves techniques for controlling cooling the antenna system 12, or other heat-generating structure, so as to remove appropriate amounts of heat generated therein.

In the illustrated embodiment, the electronic circuitry within the antenna system 12 has a known configuration, and is therefore not illustrated and described here in detail. Instead, the circuitry is described only briefly here, to an extent that facilitates an understanding of the present invention. In particular, the antenna system 12 includes a two-dimensional array of not-illustrated antenna elements, each column of the antenna elements being provided on a respective one of the slats, including the slats 14 and 16. Each slat includes separate and not-illustrated transmit/receive circuitry for each antenna element. It is the transmit/receive circuitry which generates most of the heat that needs to be withdrawn from the slats. The heat generated by the transmit/receive circuitry is shown diagrammatically in FIG. 1, for example by the arrows at 18 and 20.

Each of the slats is configured so that the heat it generates is transferred to a tube 22 or 24 extending through that slat. Alternatively, the tube 22 or 24 could be a channel or passageway extending through the slat, instead of a physically separate tube. A fluid coolant flows through each of the tubes 22 and 24. As discussed later, this fluid coolant is a two-phase coolant, which enters the slat in liquid form. Absorption of heat from the slat causes part or all of the liquid coolant to boil and vaporize, such that some or all of the coolant leaving the slats 14 and 16 is in its vapor phase. This departing coolant then flows successively through a separator 26, a heat exchanger 28, a pump 30, and a respective one of two orifices 32 and 34, in order to again reach the inlet ends of the tubes 22 and 24. The pump 30 causes the coolant to circulate around the endless loop shown in FIG. 1. In the embodiment of FIG. 1, the pump 30 consumes only about 0.1 kilowatts to 2.0 kilowatts of power.

Separator 26 separates the vaporized portion of the liquid coolant flowing through tubes 22 and 24 from the unvaporized liquid portion. The vaporized portion is provided to heat exchanger 28, and the liquid portion is provided at separator pump 36.

Separator pump 36 receives the liquid portion of the coolant that has not vaporized in tubes 22 and 24 circulates this fluid back through tubes 22 and 24 via orifices 32 and 34.

The orifices 32 and 34 facilitate proper partitioning of the coolant among the respective slats, and also help to create a large pressure drop between the output of the pump 30 and the tubes 22 and 24 in which the coolant vaporizes. It is possible for the orifices 32 and 34 to have the same size, or to have different sizes in order to partition the coolant in a proportional manner which facilitates a desired cooling profile.

Ambient air or liquid 38 is caused to flow through the heat exchanger 28, for example by a not-illustrated fan of a known type. Alternatively, if the apparatus 10 was on a ship, the flow 38 could be ambient seawater. The heat exchanger 28 transfers heat from the coolant to the air flow 38. The heat exchanger 28 thus cools the coolant, thereby causing any portion of the coolant which is in the vapor phase to condense back into its liquid phase.

The liquid coolant exiting the heat exchanger 28 is supplied to the expansion reservoir 40. Since fluids typically take up more volume in their vapor phase than in their liquid phase, the expansion reservoir 40 is provided in order to take up the volume of liquid coolant that is displaced when some or all of the coolant in the system changes from its liquid phase to its vapor phase. The amount of the coolant that is in its vapor phase can vary over time, due in part to the fact that the amount of heat being produced by the antenna system 12 will vary over time, as the antenna system operates in various operational modes.

Pressure controller 42 maintains the coolant at a desired subambient pressure in portions of the cooling loop downstream of the orifices 32 and 34 and upstream of the pump 30, as described in greater detail in conjunction with FIGS. 2 and 3. Typically, the ambient air pressure will be that of atmospheric air, which at sea level is 14.7 pounds per square inch area (psia).

When antenna system 12 (or any other heat-generating device) undergoes transient heat loads, this subambient pressure may need to be adjusted to allow greater or lesser amounts of heat transfer from slats 14 and 16 at a desired temperature. According to the teachings of the invention, slats 14 and 16 are maintained at a desired temperature by feeding back the pressure of the coolant as it exits passageways 22 and 24. This pressure is indicative of the temperature at slats 14 and 16. In response, pressure controller 42 may respond by raising or lowering the pressure of the coolant, which affects the boiling temperature of the coolant and therefore the rate of heat transfer. By feeding back the coolant pressure, as opposed to the temperature of the slats, associated thermal delay is eliminated from the control loop, permitting direct control of pressure without taking into account the thermal delay.

Turning now in more detail to the coolant, one highly efficient technique for removing heat from a surface is to boil and vaporize a liquid which is in contact with the surface. As the liquid vaporizes, it inherently absorbs heat. The amount of heat that can be absorbed per unit volume of a liquid is commonly known as the latent heat of vaporization of the liquid. The higher the latent heat of vaporization, the larger the amount of heat that can be absorbed per unit volume of liquid being vaporized.

The coolant used in the disclosed embodiment of FIG. 1 is water. Water absorbs a substantial amount of heat as it vaporizes, and thus has a very high latent heat of vaporization. However, water boils at a temperature of 100° C. at atmospheric pressure of 14.7 psia. In order to provide suitable cooling for an electronic apparatus such as the phased array antenna system 12, the coolant needs to boil at a temperature in the range of approximately 60° C. When water is subjected to a subambient pressure of about 3 psia, its boiling temperature decreases to approximately 60° C. Thus, in the embodiment of FIG. 1, the orifices 32 and 34 permit the coolant pressure downstream from them to be substantially less than the coolant pressure between the pump 30 and the orifices 32 and 34.

Water flowing from the pump 30 to the orifices 32 and 34 has a temperature of approximately 60° C. to 65° C., and a pressure in the range of approximately 15 psia to 100 psia. After passing through the orifices 32 and 34, the water will still have a temperature of approximately 60° C. to 65° C., but will have a much lower pressure, in the range about 2 psia to 8 psia. Due to this reduced pressure, some or all of the water will boil as it passes through and absorbs heat from the tubes 22 and 24, and some or all of the water will thus vaporize. After exiting the slats, the water vapor (and any remaining liquid water) will still have the reduced pressure of about 2 psia to 8 psia.

When this subambient coolant water reaches the heat exchanger 28, heat will be transferred from the water to the forced air flow 38. The air flow 38 has a temperature less than a specified maximum of 55° C., and typically has an ambient temperature below 40° C. As heat is removed from the water coolant, any portion of the water which is in its vapor phase will condense, such that all of the coolant water will be in liquid form when it exits the heat exchanger 28. This liquid will have a temperature of approximately 60° C. to 65° C., and will still be at the subambient pressure of approximately 2 psia to 8 psia. This liquid coolant will then flow to the pump 30 with a tee connection prior to the expansion reservoir 40. The pump 30 will have the effect of increasing the pressure of the coolant water, to a value in the range of approximately 15 psia to 100 psia, as mentioned earlier.

It will be noted that the embodiment of FIG. 1 operates without any refrigeration system. In the context of high-power electronic circuitry, such as that utilized in the phased array antenna system 12, the absence of a refrigeration system can result in a very significant reduction in the size, weight, and power consumption of the structure provided to cool the antenna system.

As mentioned above, the coolant used in the embodiment of FIG. 1 is water. However, it would alternatively be possible to use other coolants, including but not limited to methanol, a fluorinert, a mixture of water and methanol, a mixture of water and ethylene glycol (WEGL), or a mixture of water and propylene. These alternative coolants each have a latent heat of vaporization less than that of water, which means that a larger volume of coolant must be flowing in order to obtain the same cooling effect that can be obtained with water. As one example, a fluorinert has a latent heat of vaporization which is typically about 5% of the latent heat of vaporization of water. Thus, in order for a fluorinert to achieve the same cooling effect as a given volume or flow rate of water, the volume or flow rate of the fluorinert would have to be approximately 20 times the given volume or flow rate of water.

Despite the fact that these alternative coolants have a lower latent heat of vaporization than water, there are some applications where use of one of these other coolants can be advantageous, depending on various factors, including the amount of heat which needs to be dissipated. As one example, in an application where a pure water coolant may be subjected to low temperatures that might cause it to freeze when not in use, a mixture of water and ethylene glycol or water and propylene glycol could be a more suitable coolant than pure water, even though the mixture has a latent heat of vaporization lower than that of pure water.

The cooling system of FIG. 1, also referred to herein as a Subambient Cooling System, or "SACS," may be used in a plurality of contexts. The teachings of the invention recognize that one or a plurality of SACS may be used to provide desired cooling. One such application and associated method and architecture is described below in conjunction with FIG. 2.

FIG. 2 is a schematic diagram illustrating a ship 100 floating on seawater 148 that includes a plurality of process equipment units 102, also referred to herein as heat-generating structures. One example of process equipment unit 102 is a phased array antenna system such as described above in conjunction with FIG. 1. Process equipment units 102 may generate substantial amounts of heat that require cooling. Ship 100 also includes a cooling system 104 for cooling the plurality of heat-generating structures 102.

Cooling system 104 includes a plurality of subambient cooling systems 110, an intermediary cooling loop 160, and a heat exchanger 146. The plurality of subambient cooling systems 110 are disposed on ship 100 in relation to respective heat-generating structures 102.

Each subambient cooling system 110 may be as described in conjunction with FIG. 1 and operate generally to cool using a coolant at subambient temperatures. As illustrated, any given heat-generating structure 102 may exchange heat with respective subambient cooling system 110, as indicated by lines 118 and 120. In one embodiment, cooling tubes are positioned within heat-generating structures 114 and 116 of phased arrays 102 in an analogous manner to that described above in conjunction with FIG. 1.

According to the teachings of the invention, it is recognized that a single large subambient cooling system 110 that could be centrally located within ship 100 may be used, but in some implementations the size of associated vapor return lines may be too large that they are not practical for certain applications. The teachings of the invention further recognize that the use of smaller higher pressure liquid lines within an intermediary loop between the heat exchanger of the subambient cooling systems 110, such as condenser heat exchanger 28 (FIG. 1), and the ambient seawater may be used to transport heat from the subambient cooling systems 110 to a heat exchanger associated with a sink, such as the seawater, such as heat exchanger 146. The teachings of the invention further recognize that one or more heat exchangers 146 may be used in conjunction with that intermediary loop.

As illustrated, intermediary loop 160 includes a hot side line 144 and a cold side line 138. Hot side line 144 contains heat received from the associated condenser heat exchanger (such as heat exchanger 28) of each subambient cooling system and provides it to heat exchanger 146. The cold side line 138 of intermediary loop 160 provides a cooling fluid to each subambient cooling system to allow condensation of the vapor created during cooling of phased arrays of the heat-generating structure, as described above. In that connection, a pump 154 may be provided to pump the cooling fluid through intermediary loop 160. Although any suitable cooling fluid may be used, water is one particularly suitable cooling fluid, as are the coolants described above in connection with FIG. 1. In some embodiments it may be desirable to use the same coolant in the SACS loop and the intermediary loop 160 to simplify the logistics associated with maintaining the two loops.

When not in use, the SACS 110 loop may be drained to an elastic bladder used as a storage tank. The use of an elastic storage tank alleviates concerns over freezing of the coolant and resultant breakage of the associated lines in the SACS or an inelastic storage tank. An elastic tank may also be used for the coolant used in intermediary loop 160. Upon startup, the coolant stored in such a bladder may be heated and melted for use in the appropriate loop.

Heat exchanger 146 exchanges heat between intermediary loop 160 and the seawater 148. In particular, a cool side inlet 150 provides seawater at ambient temperature, which may be approximately 35° C., and hot side outlet 152 provides heated seawater back to the sea. In this manner, each of the subambient cooling systems 110 may exchange heat generated by process equipment 102 with the eventual heat sink of the sea or ocean. It will be recognized that instead of one heat exchanger 146, a plurality of heat exchangers may also be used. In such a case, intermediary loop 160 may comprise a single loop with multiple outlets to each heat exchanger 146, or may be replaced with a plurality of intermediary loops connecting respective subambient cooling systems 110 with respective heat exchangers 146. The size of lines 138 and 144 may be selected based on the particular heat transfer needs of heat generating structures 102, subambient cooling systems 110, and the temperature of seawater 148.

Although the present invention has been disclosed in the context of a plurality of phased array antenna systems on a ship, it will be recognized that it can be utilized in a variety of other contexts, including but not limited to a power converter assembly, or certain types of directed energy weapon (DEW) systems. Although the present invention and its advantages have been described in detail, it should be understood that various changes, substitutions, and alterations can be made therein without departing from the spirit and scope of the invention as defined by the appended claims.

What is claimed is:

1. A system for cooling a plurality of heat-generating structures on a ship, the plurality of heat-generating structures each disposed in respective environments having a respective ambient pressure, the system comprising:

for each heat generating structure:

a respective fluid coolant;

structure which reduces a pressure of said respective coolant to a subambient pressure at which said respective coolant has a boiling temperature less than a temperature of said heat-generating structure;

structure which directs a flow of said respective coolant in the form of a liquid at said subambient pressure in a manner causing said liquid coolant to be brought into thermal communication with said heat-generating structure, the heat from said heat-generating structure causing said liquid coolant to boil and vaporize so that said respective coolant absorbs heat from said heat-generating structure as said respective coolant changes state, wherein said heat-generating structure includes a plurality of sections which each generate heat, and wherein said structure for directing the flow of said coolant brings respective portions of said coolant into thermal communication with respective said sections of said heat-generating structure;

a heat exchanger for removing heat from said respective coolant flowing through said loop so as to condense said coolant to a liquid; and at least one intermediary cooling loop operable to thermally couple the respective coolants with a body of water on which the ship floats, the at least one intermediary cooling loop comprising at least one intermediary cooling loop heat exchanger operable to exchange heat between the body of water and an intermediary cooling fluid in the intermediary cooling loop.

2. A system according to claim 1, wherein the at least one intermediary cooling loop comprises a single intermediary cooling loop thermally coupling each respective coolant to the body of water.

3. A system according to claim 1, wherein said respective coolant is one of water, methanol, a fluorinert, and a mixture of water and ethylene glycol.

4. A system according to claim 1, wherein the intermediary cooling fluid is selected from the group consisting of water, methanol, a fluorinert, a mixture of water and ethylene glycol, and a mixture of water and propylene glycol.

5. An apparatus, comprising heat-generating structure disposed in an environment having an ambient pressure, and a cooling system for removing heat from said heat-generating structure, said heat-generating structure disposed on a ship, said cooling system including:

a first fluid coolant;

structure which reduces a pressure of said first coolant to a subambient pressure at which said coolant has a boiling temperature less than a temperature of said heat-generating structure;

structure which directs a flow of said first coolant in the form of a liquid at said subambient pressure in a manner causing said liquid coolant to be brought into thermal communication with said heat-generating structure, the heat from said heat-generating structure causing said liquid coolant to boil and vaporize so that said first coolant absorbs heat from said heat-generating structure as said coolant changes state, wherein said structure is configured to circulate said first coolant through a flow loop while maintaining the pressure of said first coolant within a range having an upper bound less than said ambient pressure;

a first heat exchanger for exchanging heat between said first coolant flowing through said loop and a second coolant in an intermediary loop so as to condense said first coolant flowing through said loop to a liquid; and a second heat exchanger for exchanging heat between said second coolant in the intermediary cooling loop and a body of water on which the ship is disposed.

6. An apparatus according to claim 5, wherein said heat-generating structure includes a passageway having a surface which extends along a length of said passageway; and wherein heat generated by said heat generating structure is supplied to said surface of said passageway along the length of said surface, said portion of said coolant flowing through said passageway and engaging said surface so as to absorb heat from said surface.

7. An apparatus according to claim 5, wherein said coolant is one of water, methanol, a fluorinert, and a mixture of water and ethylene glycol.

8. An apparatus according to claim 5, wherein said structure for directing the flow of said fluid includes a plurality of orifices and causes each said portion of said coolant to pass through a respective said orifice before being brought into thermal communication with a respective said section of said heat-generating structure.

9. An apparatus according to claim 5, and further comprising a pump for circulating the second coolant.

10. A method for cooling heat-generating structure on a ship on a body of water, the heat-generating structure disposed in an environment having an ambient pressure, the method comprising:

providing a primary fluid coolant;

reducing a pressure of said primary fluid coolant to a subambient pressure at which said primary coolant has a boiling temperature less than a temperature of said heat-generating structure;

bringing said primary coolant at said subambient pressure into thermal communication with said heat-generating structure, so that said primary coolant boils and vaporizes to thereby absorb heat from said heat-generating structure;

circulating said primary coolant through a flow loop while maintaining the pressure of said primary coolant within a range having an upper bound less than said ambient pressure, said flow loop in thermal communication with a heat exchanger for removing heat from said primary coolant so as to condense said primary coolant to a liquid;

providing an intermediary cooling loop in thermal communication with said heat exchanger;

exchanging, by the heat exchanger, heat from said primary coolant with an intermediary loop coolant in said intermediary cooling loop; and exchanging heat from said intermediary cooling loop coolant with a sink fluid.

11. A method according to claim 10, wherein the sink fluid is a portion of the body of water on which the ship is disposed.

12. A method according to claim 10, and further comprising selecting for use as said primary coolant one of water, methanol, a fluorinert, a mixture of water and ethylene glycol, and a mixture of water and propylene glycol.

13. A method according to claim 10, and further comprising:

providing a plurality of orifices; and causing each said portion of said primary coolant to pass through a respective said orifice before being brought into thermal communication with a respective said section of said heat-generating structure.

14. A method according to claim 10, and further comprising configuring said intermediary cooling loop to include a pump for circulating said intermediary loop coolant through said intermediary cooling loop.

15. A method for cooling a plurality of heat-generating structures on a ship on a body of water, the plurality of heat-generating structures each disposed in respective environments having a respective ambient pressure, the method comprising:

for each heat-generating structure;

providing a respective fluid coolant;

reducing a pressure of said respective fluid coolant to a subambient pressure at which said respective coolant has a boiling temperature less than a temperature of said heat-generating structure;

bringing said respective coolant at said subambient pressure into thermal communication with said heat-generating structure so that said coolant boils and vaporizes to thereby absorb heat from said heat-generating structure; and circulating said respective coolant through a respective flow loop while maintaining the pressure of said respective coolant within a range having an upper bound less than said respective ambient pressure, said respective flow loop in thermal communication with a respective heat exchanger for removing heat from said respective coolant so as to condense said respective coolant to a liquid;

providing at least one intermediary cooling loop;

exchanging, by each respective heat exchanger, heat from each respective coolant with said at least one intermediary cooling loop so as to condense at least a portion of said respective coolant to a liquid; and exchanging heat from said at least one intermediary cooling loop with the body of water.

16. A method according to claim 15, wherein the at least one intermediary cooling loop comprises a single intermediary cooling loop thermally coupling each respective coolant to the body of water.

17. The method of claim 16, and further comprising configuring said single intermediary cooling loop to include an intermediary cooling loop fluid coolant selected from the group consisting of water, methanol, a fluorinert, a mixture of water and ethylene glycol, and a mixture of water and propylene glycol.

18. The method of claim 15, and further comprising for each heat-generating structure, providing a plurality of orifices; and causing each said portion of said coolant to pass through a respective said orifice before being brought into thermal communication with a respective said section of said heat-generating structure.

19. The method of claim 15, and further comprising configuring said at least one intermediary cooling loop to include a pump for circulating said coolant through said intermediary cooling loop.

* * * * *